United States Patent [19]

Sidlinger et al.

[11] 4,225,131

[45] Sep. 30, 1980

[54] PORTABLE EXERCISING DEVICE FOR MULTIPLE ROUTINES

[76] Inventors: Bruce C. Sidlinger; Joanne Sidlinger, both of 2810 Country Club Rd., both of Garland, Tex. 75042; Bruce D. Sidlinger, 7626 Callaghan Rd., Apt. 3006, San Antonia, Tex. 78229

[21] Appl. No.: 875,102

[22] Filed: Feb. 3, 1978

[51] Int. Cl.[3] ..... A63B 5/18

[52] U.S. Cl. ..... 272/109; 272/65; 272/145; 272/70; 272/900

[58] Field of Search ..... 272/65, 66, 144, 145, 272/143, 109, 62, 900, 70; 128/25 R

[56] References Cited

U.S. PATENT DOCUMENTS

| | | | |
|---|---|---|---|
| 2,858,132 | 10/1958 | Sidlinger | 272/66 X |
| 3,134,592 | 5/1964 | Sharkey | 272/145 |
| 3,857,561 | 12/1974 | Cecchettini et al. | 272/109 X |
| 4,046,373 | 9/1977 | Kim | 272/145 X |
| 4,077,623 | 3/1978 | Clausell | 272/65 |

*Primary Examiner*—Richard C. Pinkham
*Assistant Examiner*—William R. Browne
*Attorney, Agent, or Firm*—Fisher, Christen & Sabol

[57] ABSTRACT

A portable exercising device which can be assembled and disassembled without the use of special tools for shipping and storage and capable of permitting the user to perform a number of exercise routines, such as controlled jumping, simulated running, hand-and-shoulder stands and sit-ups. A small rebounding bed is detachably connected with an auxiliary frame, the latter having several adjustable attachements such as elevated hand grips for jumping on the rebounding bed, leg supports at a lower level for doing sit-ups, and another set of hand grips and shoulder pads for practicing hand and shoulder standing, in which case the elevated hand grips serve as foot rests. The auxiliary frame extends away from the rebounding bed to stabilize the elevated hand grips for jumping, and several of the attachments are adjustable.

18 Claims, 5 Drawing Figures

PORTABLE EXERCISING DEVICE FOR MULTIPLE ROUTINES

This invention relates to exercising devices, and more particularly to a portable device with a small rebounding bed and an auxiliary frame which enables the user to practice a variety of routines including running in place, sit-ups and hand stands, as well as other exercises which are limited only to the imagination of the user.

An object of the invention is to provide a portable exercising device which can be easily dismantled for shipment and quickly assembled for use without the use of special tools.

Another object of the invention is to provide an exercise device which can be attached to a small rebounding bed of known construction or similar device such as a small treadmill, or may be used alone to make it possible for the user to perform a variety of routines which cannot be performed by use of the rebounding bed alone.

Other objects and advantages will be apparent to those skilled in the art after reading the following specification in connection with the annexed drawings, in which:

BRIEF DESCRIPTION OF DRAWINGS

FIGS. 1–3 are perspective views of a preferred form of portable exercising device constructed in accordance with the invention in which FIG. 1 illustrates its use for jumping, or simulated running in place;

FIG. 2 illustrates its use for practicing sit-ups;

FIG. 3 shows the user doing a shoulder and hand stand;

Figure 2:
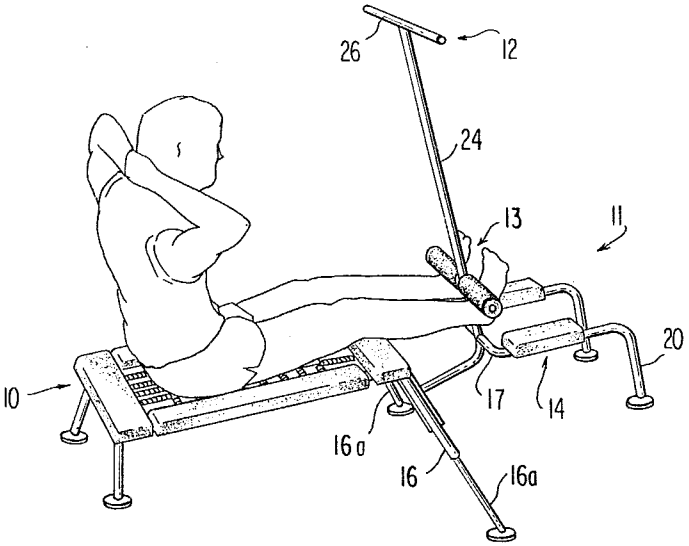

In the drawing the numeral 10 indicates generally, a small rebounding bed of the type disclosed in U.S. Pat. No. 2,590,049, numeral 11 indicates generally a framework for supporting hand grips, indicated generally at 12, leg supports indicated generally at 13, and shoulder pads indicated generally at 14.

Figure 3:
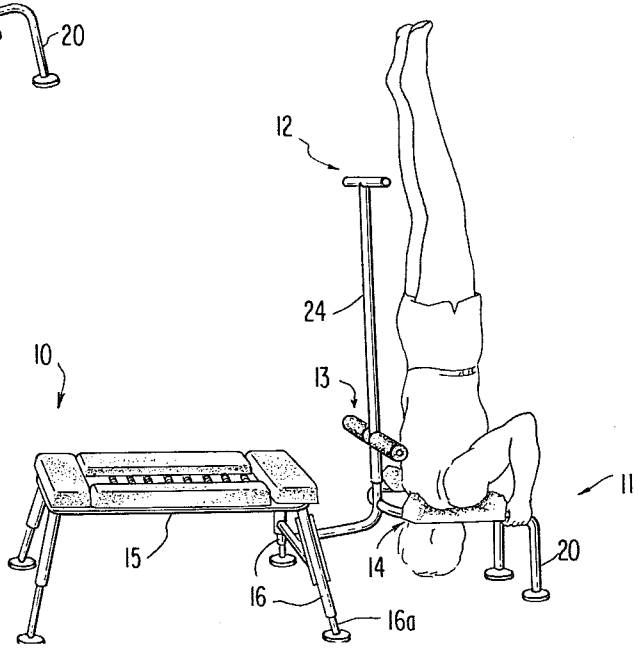
Figure 1:
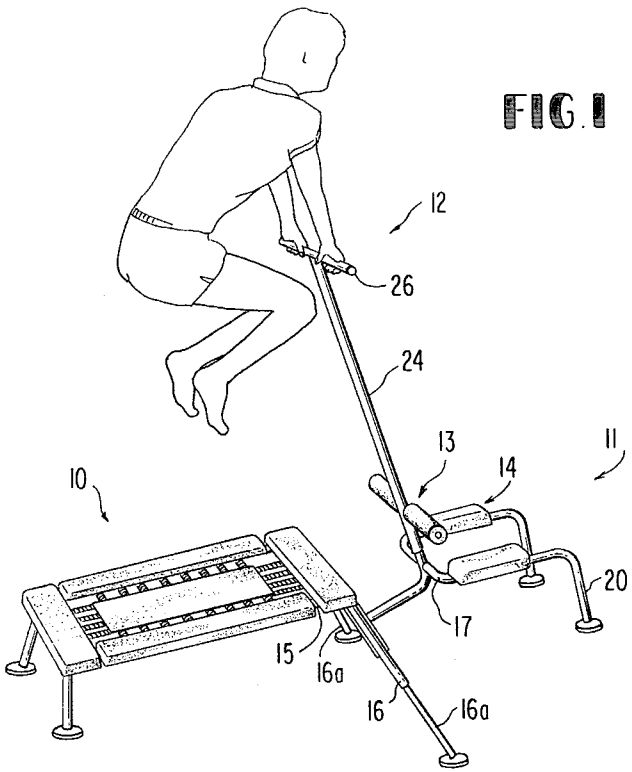
Figure 4:
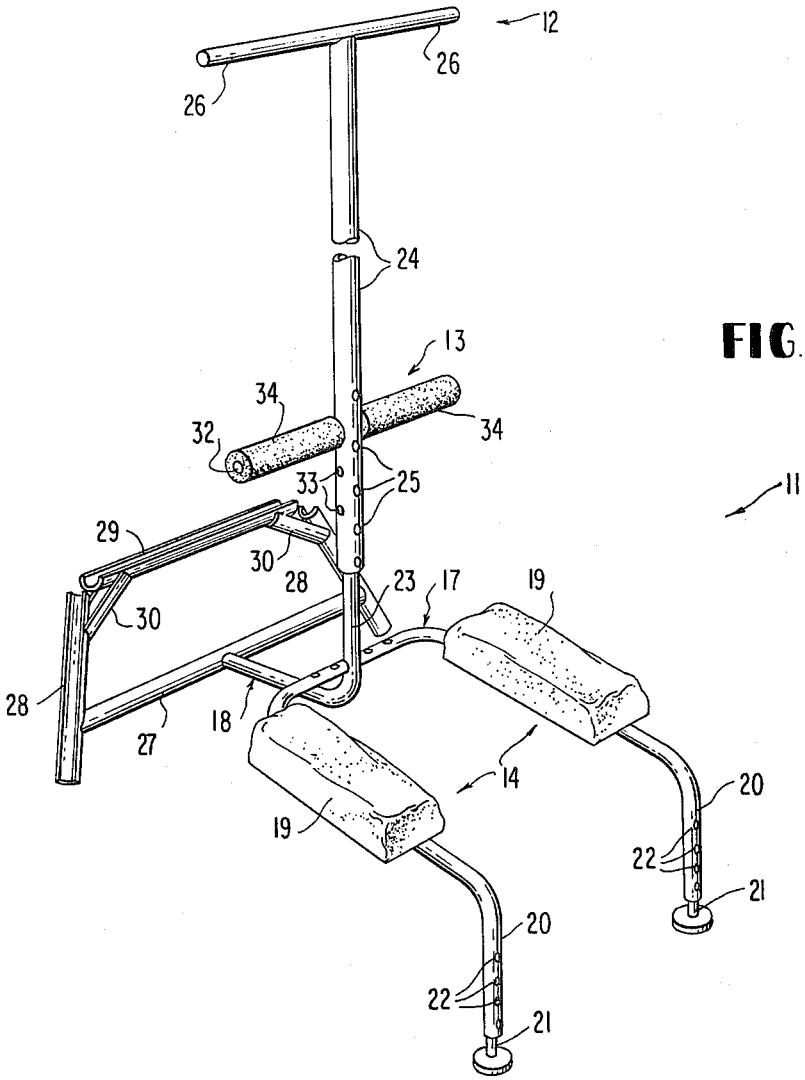
FIG. 4 is a perspective view, on an enlarged scale, of that portion of the device which is detachably connected to a small rebounding bed.
Figure 5:
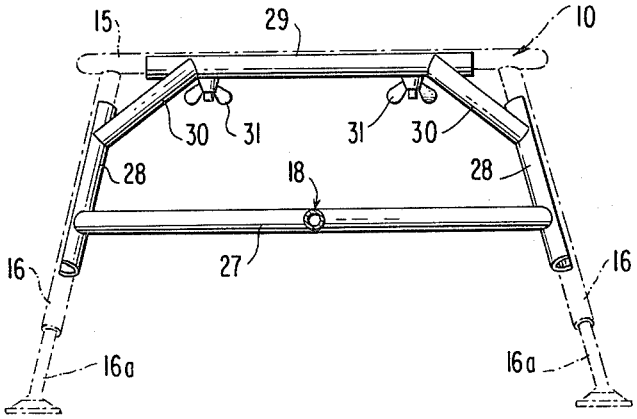
FIG. 5 is a vertical section looking towards the rebounding bed illustrating the manner in which the bed and auxiliary support are detachably joined together.

The rebounding bed 10 is preferably rectangular and includes a horizontal framework 15 made of tubing which is supported by at least two outwardly and downwardly divergent legs 16 which may be provided with telescoping adjustable extension 16*a*, which allows the bed to be tilted as shown in FIGS. 1 and 2 to be disposed in the horizontal position of FIG. 3. The bed itself consists of a flexible sheet secured by the frame 15 by a series of tensioned springs which may be connected to the frame by adjustable connectors to permit varying the spring tension and the springs may be covered on their upper sides by appropriate padding or by the interweaving of an elastic cord.

The auxiliary frame 11 is also preferably formed from tubular material which comprises a first tube 17 and a second tube 18. The first tube is generally U-shaped and formed to provide a pair of horizontal portions which support a pair of shoulder supporting pads 19 and terminate in a pair of down wardly extending legs 20 which may be provided with telescoping extensions 21 which can be adjusted in length by a pin inserted through opening 22.

The second tube 18 is generally L-shaped, and joined to the tube 17 so that one end 23 extends in an upward direction to telescopically engage with a vertically extending tubular section 24, the portion of which may be adjusted by a pin inserted through matching openings 25. The upper end of tube 24 supports a pair of outwardly extending hand grips 26 for use as shown in FIG. 1. The other end of tube 24 extends generally in a horizontal direction away from the first 17 and is joined, as by welding, to the center of a transverse horizontal member 27.

Horizontal member 27 is welded, or otherwise attached, at its respective ends to a pair of elongated half-sleeves 28 which are disposed angularly with respect to each so as to mate with the inner surfaces of legs 16 of the rebounding device. In this connection it should be noted that the length of the legs 20 of the exercise framework 11 should preferably be short enough so that with the extensions 21 fully retracted the framework 11 may rest in a level position on the floor or ground when used alone. Another elongated half-sleeves 29 is connected to the upper ends of the half-sleeves 28 by elements 30, or the half-sleeves 28 and 29 could be formed integrally.

The horizontal frame member 15 of the bed 10 may be provided with a pair of downwardly projecting bolts which may extend through matching holes drilled in half-sleeve 29 to receive wing nuts 31 which allow the half-sleeve 29 to be drawn upwardly toward frame member 15 when the device is assembled. In this connection it should be noted that the relationship between the half-sleeves 28 and the half-sleeve 29 is such that when the former are in firm engagement with the diverging legs 16 there will still remain some space between the horizontal members 15 and 29 to ensure the rigidity of the connection between the two assemblies 10 and 11.

The leg support 13 may comprise an elongated rod 32 which passes through one of a series of openings 33 drilled in the vertical extension 24, the protruding ends of the rod being fitted with cylindrical pads 34 to the legs of the user down when executing sit-ups, as shown in FIG. 2. If desired, the vertical tube 23 may extend upwardly a sufficient distance that openings in this tube can also be drilled to match with various ones of the openings 33 whereby the height of the hand grips 26 can be adjusted by removal and insertion of rod 32 instead of a separate pin inserted in openings 25. Either arrangement, however, will allow the adjustment of the grips 26 and pads 34 with respect to the plane of the rebounding bed 10 or the should pads 19.

Other objects and improvements will be obvious to those skilled in the art which would come within the scope of the annexed claims.

We claim:

1. In a portable exercising device the combination including a small rebounding bed, means to support said bed elevated from a horizontal supporting surface , auxiliary support means for supporting a user during an exercise program, said support means being spaced forwardly from said rebounding bed, said support means further including at least one member that engages the supporting surface at a location spaced away from the rebounding bed to stabilize the device during use, said support means also including means for engaging the body of the user while performing an exercise on the bed, an elevated hand grip means extending upwardly from said body engaging means, and positioned between said bed and said support means to a position that permits a user to grasp said hand grip means when in a standing position on said bed while practicing controlled jumps or to simulate running while holding said hand grip means.

2. The device of claim 1, wherein the height said hand grip means is adjustable.

3. The device of claim 1, wherein said auxiliary support means includes horizontally extending leg support means positioned to one side of said bed and spaced above the plane of said bed to permit the user to practice sit-ups while lying on said bed.

4. The device of claim 3, wherein the position of said leg support means is adjustable.

5. The device of claim 3, wherein said device includes an upstanding post, and said leg support means is mounted on said post.

6. The device of claim 5, wherein said leg support means is mounted for vertical adjustment on said post.

7. The device of claim 6, wherein said post is also provided with hand grip means at its upper end.

8. The device of claim 7, wherein said leg support means and said hand grip means are each mounted on said post for independent vertical adjustment.

9. The device of claim 1, wherein said auxiliary support means is provided with a pair of horizontally spaced padded shoulder support means positioned to one side of said bed and a pair of horizontally spaced hand grip means cooperating with said shoulder support means to enable the user to execute a hand and shoulder stand.

10. The device of claim 9, wherein said body engaging means serves as foot rest means elevated above the plane of the shoulder support means for contact with the legs of the user to assist in executing a hand and shoulder stand.

11. The device of claim 10, wherein said body engaging means is mounted on an elongated vertical support means included in said auxiliary support means.

12. The device of claim 11, wherein said vertical support means includes means to adjust the vertical position of said body engaging means.

13. The device of claim 11, wherein said vertical support means is positioned to one side of said bed and also includes horizontally extending leg support means to permit the user alternatively to execute a sit-up while lying on the bed.

14. The device of claim 13, wherein said auxiliary support means is joined with said rebounding bed by separable connecting means.

15. The device of claim 14, wherein said vertical support means is joined with said auxiliary support means by separable connecting means.

16. The device of claim 15, wherein said rebounding bed comprises a frame means including a horizontal member provided with at least two downwardly extending horizontally spaced legs, and said auxiliary support means comprises auxiliary frame means for separable mating with the horizontal member and said two legs of the rebounding bed, and connecting means for rigidly joining said frame means and auxiliary frame means together.

17. The device of claim 16, wherein the horizontal member and two legs of the frame means are tubular, the two legs being positioned in downwardly divergent relationship, the auxiliary frame means including two elongated oppositely directed half-sleeves arrange to demountably engage with the inner surfaces of the two legs.

18. The device of claim 17, wherein the auxiliary frame means includes a horizontal member joined with the two half-sleeves, and the device includes separable connecting means between the frame means and auxiliary frame means to draw the half-sleeves upwardly toward the divergent legs.

* * * * *